US009856799B1

(12) United States Patent
McQuillen et al.

(10) Patent No.: US 9,856,799 B1
(45) Date of Patent: Jan. 2, 2018

(54) METHODS AND SYSTEMS FOR AN OXYGEN SENSOR

(71) Applicant: Ford Global Technologies, LLC, Dearborn, MI (US)

(72) Inventors: Michael McQuillen, Warren, MI (US); Gopichandra Surnilla, West Bloomfield, MI (US); Richard E. Soltis, Saline, MI (US); Daniel A. Makled, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/202,396

(22) Filed: Jul. 5, 2016

(51) Int. Cl.

| | |
|---|---|
| ***F02D 41/14*** | (2006.01) |
| ***F02D 41/20*** | (2006.01) |
| ***F02D 35/00*** | (2006.01) |
| ***F02D 41/26*** | (2006.01) |
| ***F02D 41/30*** | (2006.01) |
| ***F02D 41/24*** | (2006.01) |

(52) U.S. Cl.
CPC ..... *F02D 35/0092* (2013.01); *F02D 41/1494* (2013.01); *F02D 41/2406* (2013.01); *F02D 41/26* (2013.01); *F02D 41/30* (2013.01); *F02D 2041/2051* (2013.01); *F02D 2250/00* (2013.01)

(58) Field of Classification Search
CPC ..... F02D 35/0092; F02D 35/0015; F02D 41/2406; F02D 41/26; F02D 41/30; F02D 41/123; F02D 41/1454; F02D 41/20; F02D 41/1476; F02D 41/1494; F02D 41/1448; F02D 2250/00; F02D 13/0203; F02D 19/0655; F02D 2041/1472; F02D 2041/2051; F02D 2041/2048; G01N 27/407; G01N 27/4065; G01N 27/417
See application file for complete search history.

(56) References Cited

U.S. PATENT DOCUMENTS

| | | | | |
|---|---|---|---|---|
| 4,762,604 | A | 8/1988 | Asakura et al. | |
| 4,860,712 | A * | 8/1989 | Nakajima | F02D 41/1476 123/697 |
| 5,518,600 | A * | 5/1996 | Uchinami | F02D 41/1494 204/401 |
| 8,721,854 | B2 * | 5/2014 | Aoki | G01N 27/4065 204/410 |
| 2005/0021214 | A1 * | 1/2005 | Ohkuma | F01N 9/00 701/101 |

(Continued)

OTHER PUBLICATIONS

McQuillen, Michael, et al., "Oxygen Sensor Element Blackening Detection," U.S. Appl. No. 15/002,199, filed Jan. 20, 2016, 50 pages.

*Primary Examiner* — Lindsay Low
*Assistant Examiner* — George Jin
(74) *Attorney, Agent, or Firm* — Julia Voutyras; McCoy Russell LLP

(57) ABSTRACT

Methods and systems are provided for reducing blackening of an oxygen sensor due to voltage excursions into an over-potential region. Before transitioning the sensor from a lower voltage to an upper voltage during variable voltage operation, an operating temperature of the sensor is reduced via adjustments to a sensor heater setting. The reduction in temperature increases the range of temperatures available to the sensor before the over-potential region is entered.

20 Claims, 5 Drawing Sheets

(56) References Cited

U.S. PATENT DOCUMENTS

| | | | | |
|---|---|---|---|---|
| 2008/0184774 | A1* | 8/2008 | Aoki | F02D 41/1494 73/23.32 |
| 2008/0277281 | A1* | 11/2008 | Hiraiwa | G01N 27/4067 204/406 |
| 2011/0147211 | A1* | 6/2011 | Inagaki | F02D 41/042 204/406 |
| 2012/0001641 | A1* | 1/2012 | Tsukada | G01N 27/407 324/537 |
| 2016/0109422 | A1 | 4/2016 | Makled et al. | |

* cited by examiner

METHODS AND SYSTEMS FOR AN OXYGEN SENSOR

FIELD

The present description relates generally to methods and systems for reducing occurrence of blackening in oxygen sensors.

BACKGROUND/SUMMARY

Intake and/or exhaust gas sensors may be operated to provide indications of various intake and exhaust gas constituents. Output from a Universal Exhaust Gas Oxygen (UEGO) sensor, for example, may be used to determine the air-fuel ratio (AFR) of exhaust gas. Indications of intake and exhaust gas oxygen content may be used to adjust various engine operating parameters, such as fueling. As such, the measurement accuracy of an oxygen sensor may be significantly affected by degradation of an element in the oxygen sensor, such as due to sensor element blackening. Oxygen sensor element blackening is a form of degradation which may occur due to operation of the sensor at a voltage which is in the over-potential region of a sensor element when a higher than threshold electric current is generated.

Various approaches have been used to reduce blackening in oxygen sensor elements. In one example approach, shown by Tsukada et al. in US 20120001641, the pumping voltage used in the oxygen pumping cell of the oxygen sensor may be limited to within a threshold voltage. The threshold voltage may correspond to the boundary of the over-potential region of the cell. During a variable voltage operation of the sensor, wherein the sensor operation is shifted between a higher and a lower voltage, each of the lower and the higher operating voltage may not exceed the threshold voltage.

The inventors herein have recognized potential issues with the above mentioned approach. As one example, by limiting the pumping voltage to a threshold limit, accuracy of the oxygen content measurement by the sensor may be reduced. The desired pumping voltage may change based on factors such as gas concentration, and a fixed upper threshold voltage limit may adversely affect sensor operation. Also, the possibility of blackening may vary based on operating temperature of the sensor, and at a higher operating temperature, even if operating within a threshold voltage, blackening of sensor elements may occur. The inventors have also recognized that the operation of the sensor in the variable voltage mode can result in blackening due to the cell overshooting the target pumping voltage during the transition to the higher voltage. The overshooting voltage may place the sensor in the over-potential region (that is, in a region where the higher voltage can cause the electrolyte in the sensor to be partially electrolyzed due to a removal of oxygen from the sensor).

In an alternate approach to control blackening in oxygen sensor elements, a lower ramping rate may be utilized to attain a desired higher voltage in the UEGO sensor cells such that there is a lower possibility of voltage overshoot to the over-potential region. However, the inventors have recognized potential issues with this approach also. As an example, using a lower ramp rate to increase the operating voltage may be time consuming and result in delays in measurements performed by the sensor, thereby adversely affecting sensor operation.

The inventors herein have recognized that the voltage threshold to cross into the over-potential region increases as the operating temperature of the sensor is decreased. Therefore by decreasing the operating temperature of the sensor, the voltage required to blacken the sensor can be raised, enabling the sensor to be operated over a larger range of voltages before sensor blackening is incurred. In one example, the issues described above may be addressed by a method for an engine comprising: during variable voltage operation of an oxygen sensor, reducing occurrence of blackening of an oxygen sensor element by decreasing an operating temperature of the oxygen sensor from a first temperature to a second temperature before transitioning from a lower operating voltage to a higher operating voltage. In this way, by adjusting the UEGO sensor temperature during variable voltage operation of the UEGO sensor, movement of the UEGO cells due into the over-potential region may be reduced, reducing the possibility of sensor blackening.

As one example, during conditions when an exhaust UEGO sensor is operated in a variable voltage mode, such as for exhaust oxygen content estimation, the temperature of the UEGO sensor may be reduced at least prior to raising the UEGO sensor voltage from a lower, nominal voltage to an upper voltage. By lowering the sensor temperature, a boundary of the over-potential region may be shifted towards a higher absolute voltage. The amount of reduction in UEGO temperature may be determined based on parameters such as a current temperature of the sensor, and the difference between the desired higher voltage and the temperature-modified boundary of the over-potential voltage. The reduction in UEGO temperature may be carried out by adjusting the settings of a heater element coupled to the UEGO sensor so that the heater generates less heat. If it is determined that the boundary of the over-potential region may not be shifted to a desired level only by lowering the UEGO temperature (such as due to higher ambient temperatures or due to other temperature constraints), the upper voltage may be limited to a threshold voltage at or lower than the boundary of the over-potential region. Then, a lower ramp rate of the voltage may be used to attain the higher voltage within the threshold range in order to reduce voltage overshoots.

In this way, by first lowering the UEGO temperature and then transitioning from a lower voltage to a higher voltage operation of the UEGO sensor, the boundary of the over-potential region may be shifted to a higher voltage value and during operation at the higher voltage, risk of blackening of UEGO sensor elements may be reduced. By enabling a higher value of voltage during variable voltage UEGO operation, a higher accuracy may be achieved in UEGO sensor measurements. Therefore, the operating voltage range of the UEGO sensor may be increased. The technical effect of shifting the boundary of the over-potential region to a higher voltage is that a faster ramp rate may be used to attain the higher voltage without the risk of voltage overshoots into the over-potential region. In addition, the risk of voltage overshoots into the over-potential region during voltage transitions are also reduced. By using a faster ramp rate, the higher voltage may be attained within a shorter time which may increase measurement accuracy. Overall, by effective reduction in risk of UEGO element blackening, degradation of the oxygen sensor is reduced, and accuracy of oxygen sensor operation is maintained, enabling efficient engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
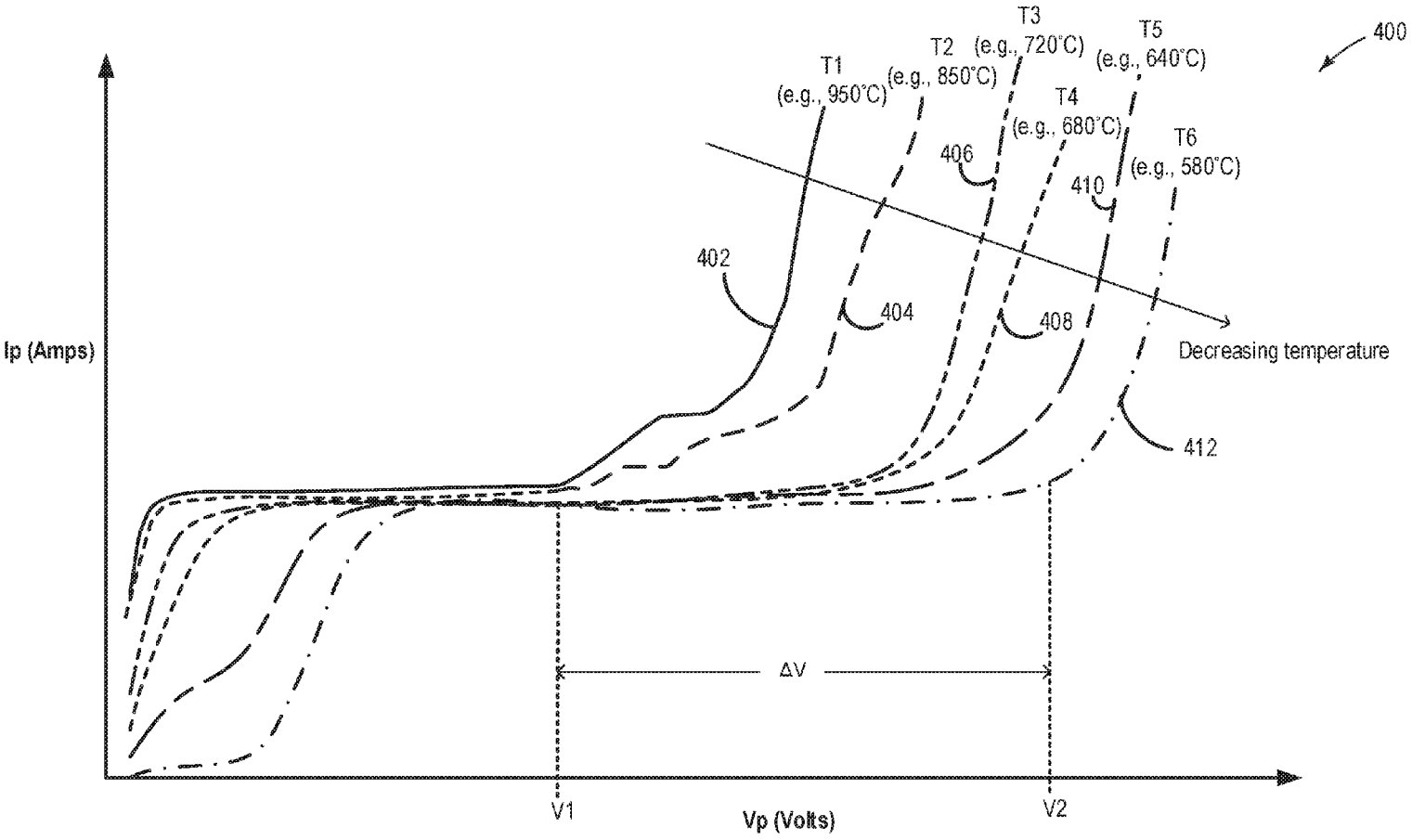
FIG. 4 shows an example plot of variation in over-potential region threshold with temperature.
Figure 5:
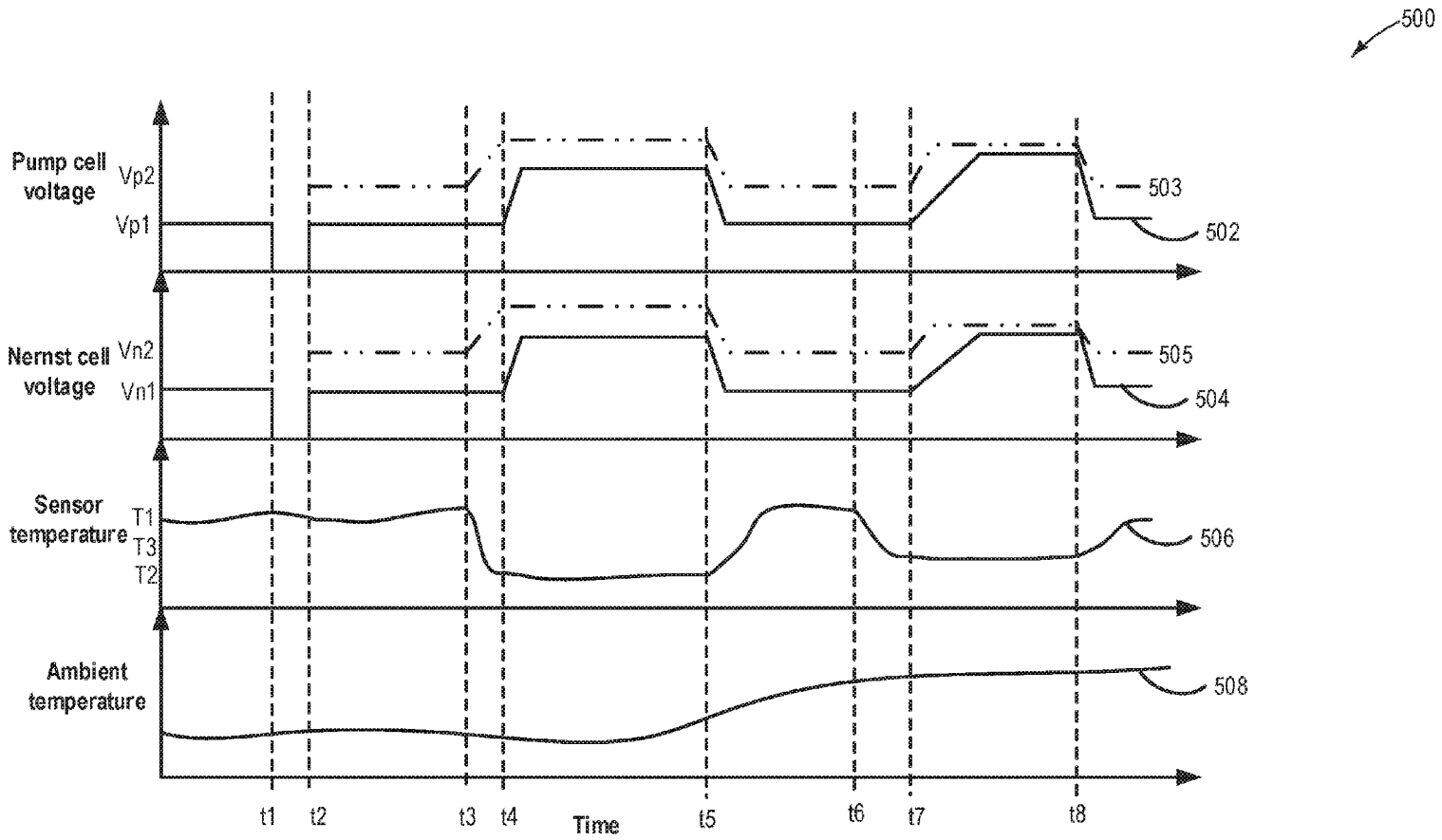
FIG. 5 shows an example operation of UEGO cells to reduce occurrence of blackening.

The following description relates to systems and methods for reduction of occurrence of blackening in one or more UEGO cells via adjustments to operating temperatures. Oxygen sensors may be disposed in an intake air passage or an exhaust gas passage, as shown in the engine system of FIG. 1. FIG. 2 shows a schematic view of an oxygen sensor that may be affected by blackening. An engine controller may be configured to perform a control routine, such as the example routine of FIG. 3, to reduce the occurrence of blackening in each of the pump cell and the Nernst cell of the UEGO sensor. FIG. 4 shows shift in the lower threshold of the over-potential region based on operating temperature of the sensor. An example operation of the UEGO sensors to reduce the occurrence of blackening is shown in FIG. 5.

Figure 1:
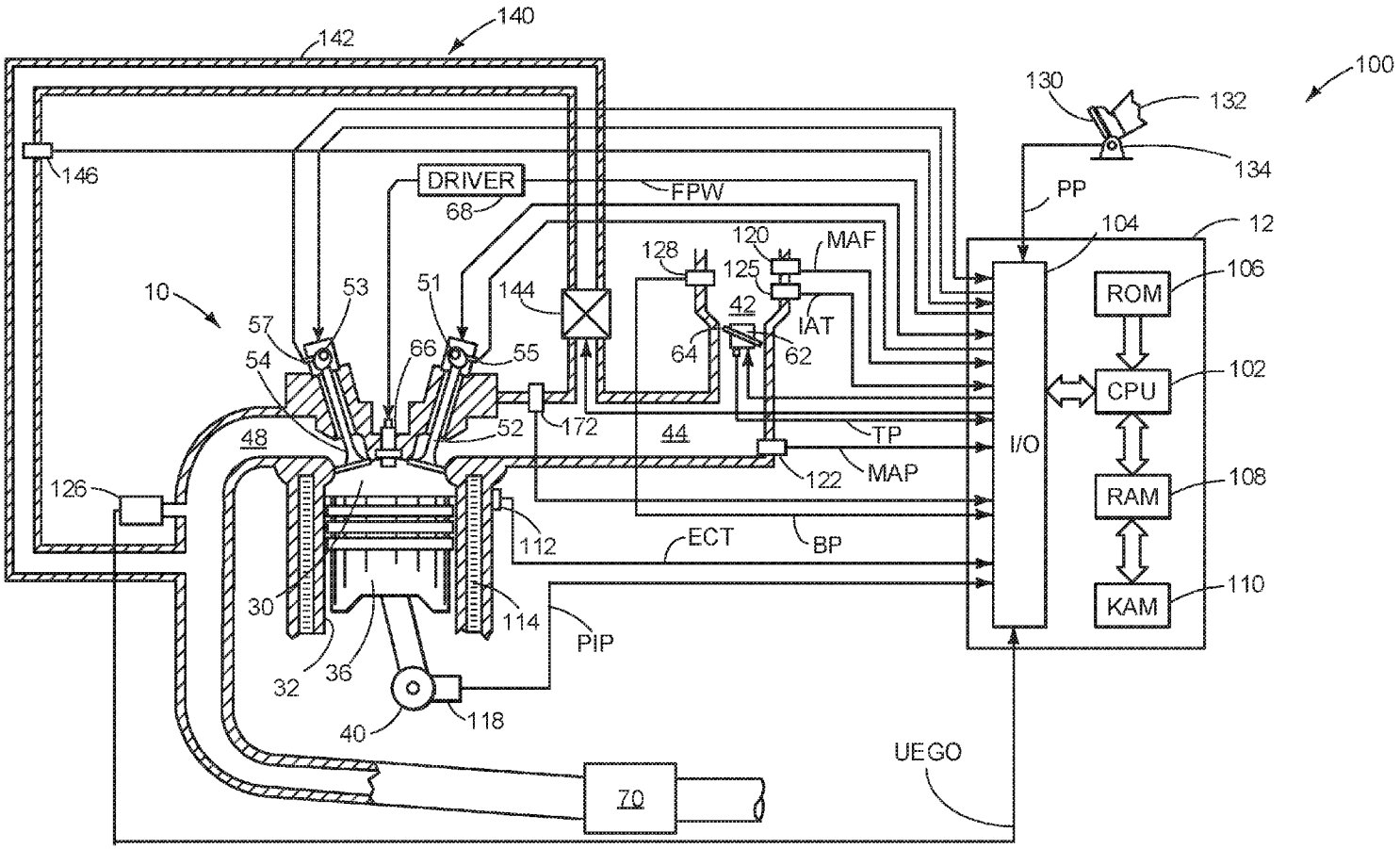
FIG. 1 shows an example engine system including intake and exhaust oxygen sensors.
Figure 2:
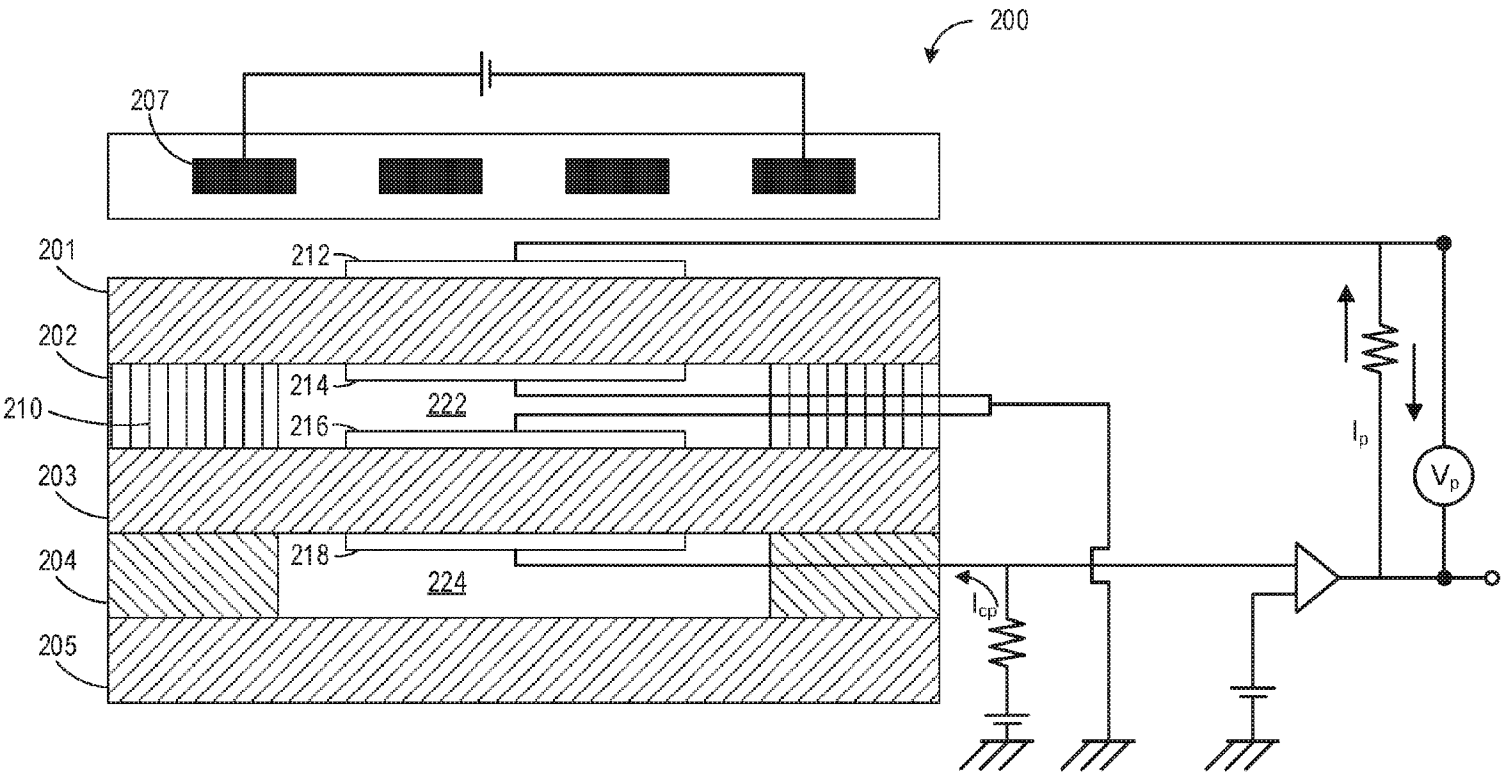
FIG. 2 shows a schematic diagram of an example UEGO sensor.

FIG. 1 is a schematic diagram showing one cylinder of a multi-cylinder engine 10 in an engine system 100. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal PP. A combustion chamber (cylinder) 30 of the engine 10 may include combustion chamber walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some embodiments, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative embodiments, the intake valve 52 and/or exhaust valve 54 may be controlled by electric valve actuation. For example, the combustion chamber 30 may alternatively include an intake valve controlled via electric valve actuation and an exhaust valve controlled via cam actuation including CPS and/or VCT systems.

A fuel injector 66 is shown coupled directly to combustion chamber 30 for injecting fuel directly therein in proportion to the pulse width of signal FPW received from the controller 12 via an electronic driver 68. In this manner, the fuel injector 66 provides what is known as direct injection of fuel into the combustion chamber 30. The fuel injector may be mounted in the side of the combustion chamber or in the top of the combustion chamber (as shown), for example. Fuel may be delivered to the fuel injector 66 by a fuel system (not shown) including a fuel tank, a fuel pump, and a fuel rail. In some embodiments, the combustion chamber 30 may alternatively or additionally include a fuel injector arranged in the intake manifold 44 in a configuration that provides what is known as port injection of fuel into the intake port upstream of the combustion chamber 30.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal TP. The air intake passage 42 may include the intake air temperature (IAT) sensor 125 and the barometric pressure (BP) sensor 128. The IAT sensor 125 estimates intake air temperature to be used in engine operations and provides a signal to the controller 12. Similarly, the BP sensor 128 estimates the ambient pressure for engine operations and provides a signal to the controller 12. The intake passage 42 may further include a mass air flow sensor 120 and a manifold air pressure sensor 122 for providing respective signals MAF and MAP to the controller 12.

An exhaust gas sensor 126 is shown coupled to the exhaust passage 48 upstream of an emission control device 70. The sensor 126 may be any suitable sensor for providing an indication of exhaust gas air/fuel ratio (AFR) such as a linear oxygen sensor or UEGO (universal or wide-range exhaust gas oxygen), a two-state oxygen sensor or EGO, a HEGO (heated EGO), a NOx, HC, or CO sensor. A detailed embodiment of the oxygen (UEGO) sensor is described with reference to FIG. 2. An oxygen sensor may be used to estimate the AFR for both intake and exhaust gas. Based on AFR estimation, engine operating parameters e.g. fueling may be regulated. In addition, by utilizing AFR estimate in exhaust gas, operating efficiency of an emission control device may be improved.

In order to improve engine operation it is desirable to be able to reduce occurrence of any degradation in the oxygen sensor. In one example, due to operation of the oxygen sensor at higher voltages (such as in the over-potential region of the sensor), higher than threshold electric currents may be generated which may partially electrolyze white Zirconia present in sensor cells to form a darker material, Zirconium oxide, thereby causing degradation in the sensor. This phenomenon may be referred as blackening of the UEGO cells. In order to reduce the occurrence of blackening, during conditions when an exhaust UEGO sensor is operated in a variable voltage mode, the temperature of the UEGO sensor may be reduced prior to raising the UEGO sensor voltage from a lower, voltage to an upper voltage. By lowering the sensor temperature, a boundary of the over-potential region may be shifted towards a higher absolute voltage. A detailed method for reduction in the occurrence of oxygen sensor degradation due to element blackening will be discussed with reference to FIGS. 3-5.

The emission control device 70 is shown arranged along the exhaust passage 48 downstream of the exhaust gas sensor 126. The device 70 may be a three way catalyst (TWC), NOx trap, various other emission control devices, or combinations thereof. In some embodiments, during operation of the engine 10, the emission control device 70 may be periodically reset by operating at least one cylinder of the engine within a particular air/fuel ratio.

Further, an exhaust gas recirculation (EGR) system 140 may route a desired portion of exhaust gas from the exhaust passage 48 to the intake manifold 44 via an EGR passage 142. The amount of EGR provided to the intake manifold 44 may be varied by the controller 12 via an EGR valve 144. Further, an EGR sensor 146 may be arranged within the EGR passage 142 and may provide an indication of one or more of pressure, temperature, and constituent concentration of the exhaust gas. A linear oxygen sensor 172 may be positioned at the intake passage, downstream of the intake throttle, to facilitate EGR regulation. Under some conditions, the EGR system 140 may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

The controller 12 is shown in FIG. 1 as a microcomputer, including a microprocessor unit 102, input/output ports 104, an electronic storage medium for executable programs and calibration values shown as read only memory chip 106 in this particular example, random access memory 108, keep alive memory 110, and a data bus. The controller 12 may receive various signals from sensors coupled to the engine 10, in addition to those signals previously discussed, including measurement of one or more of air fuel ratio and humidity from oxygen sensors 126 and 172, inducted mass air flow (MAF) from the mass air flow sensor 120; engine coolant temperature (ECT) from a temperature sensor 112 coupled to a cooling sleeve 114; a profile ignition pickup signal (PIP) from a Hall effect sensor 118 (or other type) coupled to crankshaft 40; throttle position (TP) from a throttle position sensor; and absolute manifold pressure signal, MAP, from the sensor 122. Engine speed signal, RPM, may be generated by the controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, the sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed. As described above, FIG. 1 shows one cylinder of a multi-cylinder engine, and each cylinder may similarly include its own set of intake/exhaust valves, fuel injector, spark plug, etc.

The controller 12 receives signals from the various sensors of FIG. 1 and employs the various actuators of FIG. 1 to adjust engine operation based on the received signals and instructions stored on a memory of the controller 12. In one example, the controller 12 may receive inputs from oxygen sensors 126 and 172 regarding operating temperature and voltage of the sensors. During, a transition from a lower operating voltage to a higher operating voltage of the oxygens sensor, the controller 12 may send a signal to a heater (heating element) coupled to the oxygen sensor to reduce the heat regenerated by the heater in order to reduce the operating temperature of the oxygen sensor. For example, an output of the sensor heater (e.g., voltage or current output of the heater) may be reduced.

FIG. 2 shows a schematic view of an example embodiment of an exhaust gas oxygen sensor, such as UEGO sensor 200, configured to measure a concentration of oxygen ($O_2$) in an exhaust gas stream during fueling conditions. In one example, UEGO sensor 200 is an embodiment of UEGO sensor 126 of FIG. 1. It will be appreciated, however, that the sensor of FIG. 2 may alternatively represent an intake oxygen sensor, such as sensor 172 of FIG. 1.

Sensor 200 comprises a plurality of layers of one or more ceramic materials arranged in a stacked configuration. In the embodiment of FIG. 2, five ceramic layers (elements) are depicted as layers 201, 202, 203, 204, and 205. These layers include one or more layers of a solid electrolyte capable of conducting ionic oxygen. Further, in some embodiments such as that shown in FIG. 2, a heater 207 may be disposed in thermal communication with the layers. The temperature setting of the heater may be adjusted to vary the operating temperature of the sensor. While the depicted UEGO sensor 200 is formed from five ceramic layers, it will be appreciated that the UEGO sensor may include other suitable numbers of ceramic layers.

Examples of suitable solid electrolytes include, zirconium oxide (also known as Zirconia $ZrO_2$) based materials. $ZrO_2$ is typically white in color. With usage at higher voltages (in the over-potential region), the two Oxygen atoms may get removed from $ZrO_2$, changing white $ZrO_2$ to dark colored metallic Zirconium (Zr) causing blackening of the corresponding element. Other causes for blackening to occur may include, but are not limited to, high operating temperature, low air and oxygen conditions. The newly formed Zr not only has ionic conductivity but also is capable of electronic conductivity. The electronic conductivity may increase proportional to the extent of blackening, which may adversely affect the accuracy of sensor measurements.

The layer 202 includes a porous material or materials creating a diffusion path 210. The diffusion path 210 is configured to introduce exhaust gases into a first internal cavity (also termed as gas detecting cavity) 222 via diffusion. The diffusion path 210 may be configured to allow one or more components of exhaust gases, including but not limited to a desired analyte (e.g., $O_2$), to diffuse into the internal cavity 222 at a more limiting rate than the analyte can be pumped in or out by pumping electrodes pair 212 and 214. In this manner, a stoichiometric level of $O_2$ may be obtained in the first internal cavity 222.

The sensor 200 further includes a second internal cavity 224 within the layer 204 separated from the first internal cavity 222 by the layer 203. The second internal cavity 224 is configured to maintain a constant oxygen partial pressure equivalent to a stoichiometric condition, e.g., an oxygen level present in the second internal cavity 224 is equal to that which the exhaust gas would have if the air-fuel ratio was stoichiometric. The oxygen concentration in the second internal cavity 224 is held constant by pumping voltage $V_{cp}$. Herein, the second internal cavity 224 may be referred to as a reference cell.

A pair of sensing electrodes 216 and 218 is disposed in communication with first internal cavity 222 and the reference cell 224. The sensing electrodes pair 216 and 218 detects a concentration gradient that may develop between the first internal cavity 222 and the reference cell 224 due to an oxygen concentration in the exhaust gas that is higher than or lower than the stoichiometric level. A high oxygen concentration may be caused by a lean intake air or exhaust gas mixture, while a low oxygen concentration may be caused by a rich mixture.

The pair of pumping electrodes 212 and 214 is disposed in communication with the internal cavity 222, and is configured to electrochemically pump a selected gas constituent (e.g., $O_2$) from the internal cavity 222 through the layer 201 and out of the sensor 200. Alternatively, the pair of pumping electrodes 212 and 214 may be configured to electrochemically pump a selected gas through the layer 201 and into the internal cavity 222. Herein, the electrolytic layer 201 together with the pumping electrodes pair 212 and 214 may be referred to as an $O_2$ pumping cell. Also, the electrolytic layer 203 together with the electrodes pair 216 and 218 may be referred to as a Nernst cell (also known as a sensing cell). The electrodes 212, 214, 216, and 218 may be made of various suitable materials. In some embodiments, the electrodes 212, 214, 216, and 218 may be at least partially made of a material that catalyzes the dissociation of molecular oxygen. Examples of such materials include, but are not limited to, electrodes containing platinum and/or gold.

The sensing cell (Nernst cell) may passively measure the oxygen concentration in the first internal (gas detection) cavity 222. The pumping cell may adjust the oxygen concentration in the cavity 222 based on feedback from the sensing cell. An external comparator circuit may compare the voltage generated by the sensing cell to a reference voltage $V_p$. In one example, under normal operating conditions, the reference voltage $V_p$ may be 450 mV. The voltage across the pumping cell may be proportional to the voltage across the Nernst cell. Therefore, at this time, the voltage generated across a Nernst cell with one electrode exposed to air (with ~20% oxygen concentration) and the other electrode exposed to a low oxygen concentration (~10 ppm oxygen) may be around 450 mV. This oxygen concentration (~10 ppm) may correspond to stoichiometry. If the oxygen concentration in the cavity 222 is less than the oxygen concentration corresponding to stoichiometry (~10 ppm) due to reductants such as carbon monoxide or hydrogen, the comparator circuit may send a signal to the pumping cell to pump oxygen into the cavity 222 from the exhaust. The oxygen will react with the reductants thus raising the oxygen concentration level until the level reaches the oxygen concentration corresponding to stoichiometry (~10 ppm) as measured by the sensing (Nernst) cell. The amount of all of these reductants in the cavity determines how much oxygen needs to be pumped into the cavity by the pumping cell to completely react. The pumping current $I_p$ is directly proportional to the oxygen concentration in the pumping cell. The amount oxygen pumped is just enough to completely react with all the reductants. The sensor may employ different techniques to determine the concentration of reductants. In one example, the pumping current which is proportional to the oxygen concentration in the pumping cell may be used to estimate the reductant concentration.

If the oxygen concentration in the cavity is greater than the oxygen concentration corresponding to stoichiometry (~10 ppm), a reverse method may take place. The sensing cell may measure a voltage less than the reference voltage $V_p$ (450 mV) and the comparator circuit may send a signal to the pumping cell to pump oxygen out of the cavity by applying a pumping current $I_p$ in the opposite direction. The pumping current $I_p$ is directly proportional to the amount of oxygen that is pumped out of the cell, which is in turn is directly proportional to the amount of oxygen diffusing into the cavity 222. This amount of oxygen may be directly proportional to the concentration of oxygen in the exhaust gas. During selected conditions, the oxygen sensor, when included as an exhaust gas oxygen sensor, may be operated with variable voltage, such as for detection of an alcohol content of the fuel combusted in the engine, humidity estimation, water detection, part-to-part and sensor aging correction, exhaust gas pressure detection, etc. As another example, when the sensor is included as an intake gas oxygen sensor, during selected conditions, the sensor may be operated in a variable voltage mode for measuring the intake air humidity, measuring the amount of water injected by a water injection system, determining washer fluid injection composition, air-fuel ratio, and for torque control based on the amount of hydrocarbons, humidity, oxygen, and EGR entering into the engine.

During variable voltage operation of the sensor, a higher voltage may be desired at the Nernst cell, and correspondingly the pumping cell voltage may be increased from a lower operating voltage to the higher voltage in order to attain the higher Nernst cell voltage. In one example, the lower operational voltage V1 used during variable voltage operation may be 450 mV and the higher operational voltage Vh may be used during variable voltage operation may be 1 V. As such, there is a direct relationship between the Nernst cell voltage and the pump cell voltage and they are proportional to each other. The pump cell voltage is the voltage applied across the pump cell in order to reach a desired measured Nernst cell voltage. So when the Nernst cell voltage is commanded to go from the low voltage (Vs) to a high voltage during variable voltage operation, the pump cell voltage also goes from the lower voltage to the higher voltage in order to achieve this. Thus, when the Nernst cell is operated at 450 mV the pump cell will be approximately 450 mV as well and when the Nernst cell voltage is desired to be at about 1V, for example, then the pump voltage will also be at about 1V.

During variable voltage operation, when the higher voltage is applied, if the applied voltage is in the over-potential region, a higher than threshold electric current may be generated. This higher than threshold electric current may result in conversion of Zirconium oxide present in each of the pump cell and the Nernst cell to metallic Zirconia which may accumulate on the electrodes of the pump cell and the Nernst cell. Such accumulation of metallic Zirconia may result in blackening of the sensor cells, which may adversely affect performance of the sensor.

In order to reduce the occurrence of such blackening, during variable voltage operation of an oxygen sensor, a controller may decrease an operating temperature of the oxygen sensor (e.g., from a first/current temperature to a second, lower temperature) before transitioning from a lower operating voltage to a higher operating voltage. The inventors herein have recognized that the voltage at which the Nernst/pump cell crosses into the over-potential region increases as the operating temperature of the sensor is decreased. In other words, a larger range of operating voltages are available for variable voltage operation of the oxygen sensor (before issues related to sensor blackening occur) at lower operating temperatures. Therefore by decreasing the operating temperature of the sensor, the upper voltage beyond which the sensor may blacken can be raised. As such, this increases sensor accuracy and reliability, and reduces sensor degradation. In one example, the operating temperature can be lowered by reducing the output of a sensor heating element. Alternatively, the operating temperature can be lowered by reducing the temperature of exhaust gas reaching the sensor.

It should be appreciated that the oxygen sensor described herein is merely an example embodiment of a UEGO sensor, and that other embodiments of intake or exhaust oxygen sensors may have additional and/or alternative features and/or designs.

In this way, the system of FIGS. 1-2 enables an engine system comprising: an engine including an exhaust; a fuel injector for delivering fuel to an engine cylinder; an oxygen sensor coupled to the exhaust, the oxygen sensor including a heater, a pump cell, and a Nernst cell; and a controller. The controller may be configured with computer readable instructions stored on non-transitory memory for: applying a first lower voltage across the pump cell; after the applying, adjusting a temperature setting of the heater to lower a temperature of each of the pump cell and the Nernst cell; after the adjusting, increasing a pump cell voltage from the first voltage to a second voltage; based on a change in current of the pump cell at the second voltage relative to the first voltage, estimating an oxygen content of exhaust gas; and adjusting engine fueling responsive to the estimated oxygen content. The system may further comprise a temperature sensor for estimating an ambient temperature, wherein the controller includes further instructions for: lowering the temperature of each of the pump cell and the Nernst cell based on the ambient temperature, the temperature setting of the heater adjusted to a higher temperature of each of the pump cell and the Nernst cell as the ambient temperature increases. Additionally or optionally, the controller may include further instructions for: increasing the pump cell voltage from the first voltage to the second voltage at a higher ramp rate when the second voltage is higher, and at a lower ramp rate when the second voltage is lower.

Figure 3:
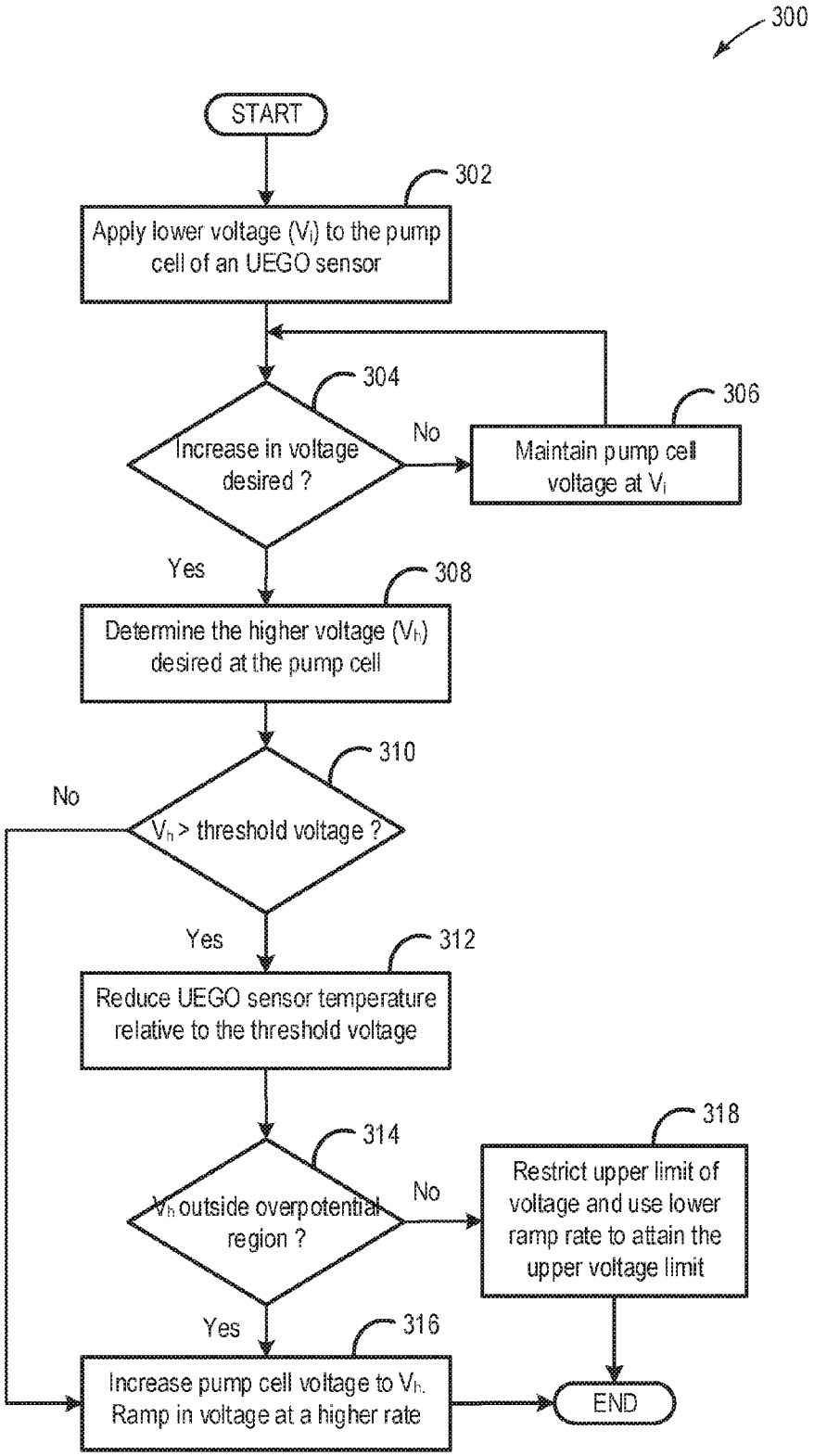
FIG. 3 shows a flow chart illustrating a method that can be implemented to reduce occurrence of blackening in oxygen sensors.

FIG. 3 illustrates an example method 300 for reducing the occurrence of blackening in universal exhaust gas oxygen (UEGO) sensor elements by adjusting an operating temperature of the sensor cells during variable voltage operation. Instructions for carrying out method 300 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below. The oxygen sensor may be one of an intake oxygen sensor coupled to an intake passage, downstream of an intake throttle (and upstream of an EGR valve), and an exhaust oxygen sensor coupled to an exhaust passage, upstream of an exhaust catalyst. The method enables reduction in the occurrence of blackening of an oxygen sensor element, in particular during variable voltage operation of the oxygen sensor, by decreasing an operating temperature of the oxygen sensor from a first temperature to a second temperature before transitioning from a lower operating voltage to a higher operating voltage. Instructions for carrying out method 300 may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, a first lower (nominal) voltage (Vi) may be applied across the pump cell. In one example the lower voltage may be 450 mV. Correspondingly, the voltage at the Nernst cell may reach the first lower voltage value. In one example, the first lower voltage may be a default voltage applied to the sensor whenever the sensor is operated for oxygen content estimation.

At 304, the routine includes determining if an increase in voltage (to a higher operating voltage) is desired at the Nernst cell. In one example, an increase in voltage may be desired responsive to an indication that the sensor is to be operated in a variable voltage mode, such as for fuel alcohol content estimation. Further, the request for variable voltage operation of the oxygen sensor may be responsive to a request for one or more of estimation of an alcohol content of fuel combusted in the engine, estimation of ambient humidity of an intake aircharge, and estimation of an oxygen content of the intake aircharge or an exhaust gas. In still further examples, an exhaust gas oxygen sensor may be operated with variable voltage for detection of an alcohol content of the fuel combusted in the engine, humidity estimation, water detection, part-to-part and sensor aging correction, exhaust gas pressure detection, while an intake gas oxygen sensor may be operated in a variable voltage mode for measuring the intake air humidity, measuring the amount of water injected by a water injection system, determining washer fluid injection composition, air-fuel ratio, and for torque control based on the amount of hydrocarbons, humidity, oxygen, and EGR entering into the engine. If it is determined that an increase in Nernst cell voltage is not desired, at 306, the pump cell voltage may be maintained at the lower voltage (Vi) level. Consequently, the Nernst cell voltage may also continue to be at the lower value.

If it is determined that a higher operating voltage is desired at the Nernst cell, at 308, the controller may determine the desired voltage (Vh) at the Nernst cell based on the engine operating conditions, and exhaust gas oxygen levels. In one example, the desired higher voltage is 1V. Also, a current operating temperature of the sensor (each of the pump cell and the Nernst cell) may be determined. In one example, the operating temperature of the sensor may be inferred from the settings of a sensor heater element (such as heater 207 in FIG. 2), and ambient conditions. In another example, the operating temperature of the sensor may be determined based on the temperature of exhaust passing through the sensor.

At 310, the routine includes determining if the desired higher voltage (Vh) is higher than a threshold voltage. The threshold voltage may correspond to a lower boundary of an over-potential region. In particular, the threshold voltage may be a voltage where a rate of rise in pump cell voltage for a given change in pump cell current is higher than a threshold. If the UEGO cells operate at a voltage within the over-potential region, a higher than threshold electric current may be generated which may result in electrolysis of the Zirconium oxide present in the cells, causing blackening of the sensor. Therefore, in order to reduce the occurrence of blackening in a UEGO sensor, the operating voltage at each of the UEGO cells may be maintained below the over-potential region. However, during a transition to the higher voltage, the actual voltage may overshoot and unintentionally land in the over-potential region. As such, the boundary of the over-potential region may depend on the operating temperature of the sensor. At lower operating temperatures, the boundary of the over-potential region may be at a higher absolute voltage, increasing the range of operating voltages available to the sensor before blackening can occur.

If it is determined that the desired higher voltage (Vh) is higher than the threshold voltage (for the current operating conditions, including the current operating temperature), it may be inferred that an increase in pump cell voltage to Vh may cause each of the pump cell, and the Nernst cell to operate within the over-potential region with higher risk of occurrence of blackening. In order to shift the boundary of the over-potential region to a higher absolute voltage, at 312, the operating temperature of the UEGO sensor may be lowered. Decreasing the operating temperature of the sensor includes decreasing the operating temperature of each of a pump cell and a Nernst cell of the oxygen sensor. The amount of reduction in UEGO temperature may be determined based on parameters such as a current temperature of the sensor, and a difference between the desired higher voltage and the temperature-modified boundary of the over-potential voltage.

In one example, the temperature may be lowered from a first temperature to a second temperature. The second temperature is adjusted as a function of each of the first temperature, and a difference between the higher operating voltage and a threshold voltage. In particular, the second temperature may be decreased as the difference between the higher operating temperature and the threshold voltage increases. Further, the second temperature may be increased as the first temperature increases. The second temperature maybe further adjusted based on ambient temperature, the second temperature raised towards the first temperature as the ambient temperature increases. As elaborated herein, as the second temperature is raised, a rate of ramping from the lower operating voltage to the higher operating voltage may be increased.

The reduction in UEGO temperature may be carried out by adjusting the settings of the heater element coupled to the UEGO sensor so that the heater generates less heat. For example, decreasing the operating temperature may include adjusting an output of a heater element of the oxygen sensor to limit heat generated during sensor operation, the output including one of a heater current and a heater voltage. In one example, the controller may send a signal to the thermostat of the heater to change the temperature settings of the heater element. In another example, the controller may send a signal to the heater to reduce an output (current or voltage) of the heater element.

For example, the controller may determine a control signal to send to the sensor element actuator, such as a pulse width of the signal being determined based on a determination of the difference between the desired higher voltage and the temperature-modified boundary of the over-potential voltage. The desired higher voltage may be based on the type of sensing required by the sensor, while the temperature-modified boundary may be based on a map or model, such as elaborated with reference to the map of FIG. 4. The controller may determine the pulse width through a determination that directly takes into account the predicted or modeled change in upper voltage, such as increasing the pulse width as the predicted difference increases. The controller may alternatively determine the pulse width based on a calculation using a look-up table with the input being desired upper voltage, or desired change in upper voltage (for variable voltage operation of the sensor) and the output being pulse-width.

Once the operating temperature of the UEGO sensor has been lowered, at 314, the routine may include determining if the desired higher operating voltage (Vh) is outside of the temperature-modified boundary of the over-potential region. If it is confirmed that the modified boundary for the over-potential region is higher than Vh, at 316, the desired higher voltage (Vh) may be applied to the pump cell, and correspondingly, the Nernst cell voltage may also increase to Vh. Also, if is it determined at 310 that the desired Vh is lower than the boundary of the over-potential region (without requiring a temperature modification), the routine may directly move to 316, wherein the operating voltage of the pump cell may be directly increased to Vh without any change in operating temperature. Since, the desired higher voltage is lower than the boundary of the over-potential region, a higher ramping rate may be used to attain Vh, without an increased risk of the voltage overshooting into the over-potential region during the transition. In particular, after decreasing the operating temperature of the oxygen sensor (e.g., from the first to the second temperature), the routine includes transitioning the sensor from the lower voltage to the higher voltage at a rate of ramping, the rate of ramping determined as a function of the second temperature relative to the first temperature. For example, the rate of ramping may be reduced as a difference between the first temperature and the second temperature decreases (that is, at a slower rate for a smaller change in voltage from the lower voltage to the higher voltage and at a faster rate for a larger change in voltage from the lower voltage to the higher voltage). By using a higher ramping rate, Vh may be reached within a shorter time, which may increase the accuracy of UEGO sensor operation.

However, at 314, if it is determined that even after lowering the sensor temperature, the desired higher voltage (Vh) is within the over-potential region, it may be inferred that the desired shift in the boundary over-potential region could not be carried out solely by lowering the temperature. This may occur when the temperature reduction is limited due to higher ambient temperatures or due to other temperature constraints. For example, when the ambient temperature is higher, even if the sensor output is reduced, the sensor operating temperature may equilibrate with the (higher) ambient temperature, resulting in a closer proximity of the higher voltage of the sensor to the over-potential region. In order to refrain from operating the UEGO cells in the over-potential region, at 318, the temperature adjustment is limited based on the ambient temperature and the upper voltage is limited to a threshold voltage at or lower than the boundary of the over-potential region with the restricted temperature adjustment. Also, a lower ramping rate may be used to attain the threshold voltage in order to reduce the possibility of voltage overshoots to the over-potential region.

After transitioning to the higher voltage at 316 and 318, the controller may generate an indication of exhaust oxygen content or fuel alcohol content (as determined based on the reason for variable voltage mode of operation), the indication based on a change in pumping current of the oxygen sensor during the variable voltage operation. Further, the controller may adjust an engine operating parameter including cylinder fueling based on the indication.

Map 400 of FIG. 4 shows an example change in the lower boundary of an over-potential region of an oxygen sensor with change in operating temperature. The map depicts a pump cell pumping current along the y-axis (Ip) and the pump cell pumping voltage along the x-axis (Vp). Example plots of change in voltage with change in current for a range of temperatures T1-T6 (herein varying from 950° C. to 580° C. as an example) are shown by plots 402-412 having lines of differing patterns (solid, dashed, etc.).

The over-potential region is defined as the region where the voltage starts to shoot up for a given current application. For example, with reference to plot 402 (calibrated for a first temperature T1, such as 950° C.), the over-potential region starts at or beyond V1. Prior to V1, the voltage is linear for a given Ip, however after V1, the voltage increases exponentially. Thus, during variable voltage operation at T1 (e.g., 950° C.), the highest upper voltage applicable at the sensor is limited to V1 (or just below it).

In comparison, with reference to plot 412 (calibrated for a second temperature T2, lower than T1, such as 580° C.), the over-potential region starts at or beyond V2, which is higher than V1. Prior to V2, the voltage is linear for a given Ip, however after V2, the voltage increases exponentially. Thus, during variable voltage operation at T2 (e.g., 580° C.), the highest upper voltage applicable at the sensor is limited to V2 (or just below it).

Thus by lowering the temperature from T1 to T2, the range of voltages available for variable voltage operation is increased by ΔV, defined herein as V2–V1. As such, the change in temperature may not be linear with the change in voltage range over all temperatures. For example, the relationship may be linear at some temperatures and non-linear at other temperatures. A relationship between the change in operating temperature of the sensor relative to the change in voltage range (or the highest voltage possible before entering the over-potential region) may be learned during a calibration routine and stored in the controller's memory as a look-up table as a function of temperature. The controller may refer to this map during the routine of FIG. 3, such as at 310 and 312.

Now turning to FIG. 5, an example map 500 is shown for adjusting operation of an oxygen sensor to reduce degradation and blackening due to excursions into an over-potential region. Herein the sensor is an exhaust oxygen sensor. In alternate examples, the sensor may be an intake oxygen sensor. Map 500 depicts changes in a pump cell voltage of the sensor at plot 502, changes in a Nernst cell voltage of the sensor at plot 504, sensor operating temperature at plot 504, and ambient temperature at plot 508. Changes to the lower boundary of an over-potential region of the pump cell are depicted at dashed line 503, and corresponding changes to the lower boundary of an over-potential region of the Nernst cell are depicted at dashed line 505. All plots are depicted over time along the x-axis.

Prior to t1, the sensor is operated in a non-variable voltage mode for oxygen content estimation. Therein, the Nernst cell is set to a first lower Nernst cell voltage Vn1 which results in a corresponding change in the voltage of the pump cell to a first lower pump cell voltage Vp1. This maintained till t1 and the current output by the pump cell following application of Vp1 is used for oxygen content estimation of an exhaust gas. Between t1 and t2, the sensor is not operated.

At t2, the sensor is transitioned to a variable voltage mode for fuel alcohol content estimation. At this time, the sensor temperature is higher (at T1) and the ambient temperature is lower. Between t2 and t3, the first voltage Vn1 is applied to the Nernst cell which results in a corresponding change in the voltage of the pump cell to the first voltage Vp1. Between t2 and t3, a change in the current output by the pump cell following application of Vp1 is learned (as delta Ip1).

During the variable voltage operation, it may be desirable to apply a second, higher voltage Vp2 to the pump cell. However at the current conditions of sensor temperature, this would result in the pump cell operating very close to, or into, the over-potential region, as indicated by the lower boundary of the over-potential region at dashed line 503. Likewise, operation of the pump cell at that voltage would require the Nernst cell to also operate very close to, or into, the over-potential region, as indicated by the lower boundary of the over-potential region at dashed line 505. To improve the margin to the over-potential region, at t3, a sensor heater output is adjusted to lower the sensor operating temperature. In particular, due to the lower ambient temperature, and based on the difference between Vp1 and Vp2, the sensor operating temperature can be reduced from T1 to T2. As a result of the reduction, the margin to the over-potential region is increased such that when Vp2 is applied to the pump cell, a risk of transitioning into the over-potential region is reduced. In addition, due to the larger margin, at t4, the Nernst cell and pump cell are transitioned to the higher voltage (Vp2 and Vn2) at a faster ramp rate.

Between t4 and t5, the second voltage Vn2 is applied to the Nernst cell which results in a corresponding change in the voltage of the pump cell to the first voltage Vp2. Between t4 and t5, a change in the current output by the pump cell following application of Vp2 is learned (as delta Ip2). Based on the difference between delta Ip1 and delta Ip2, an oxygen content of fuel combusted in the engine is learned.

At t5, another variable voltage mode of operation is requested for exhaust oxygen content estimation. Accordingly, at t5, the sensor is transitioned to a variable voltage mode by reducing the voltage of the Nernst and pump cells to the first lower voltage (Vn1 and Vp1). In addition, the sensor output is adjusted to raise the sensor operating temperature to T1. The ambient temperature may have increased in the meantime.

Between t5 and t6, the first voltage Vn1 is applied to the Nernst cell which results in a corresponding change in the voltage of the pump cell to the first voltage Vp1. Between t5 and t6, a change in the current output by the pump cell following application of Vp1 is learned (as delta Ip3).

During the variable voltage operation, it may be desirable to apply the second, higher voltage Vp2 to the pump cell. However at the current conditions of sensor temperature, this would result in the pump cell operating very close to, or into, the over-potential region, as indicated by the lower boundary of the over-potential region at dashed line 503. Likewise, operation of the pump cell at that voltage would require the Nernst cell to also operate very close to, or into, the over-potential region, as indicated by the lower boundary of the over-potential region at dashed line 505. To improve the margin to the over-potential region, at t6, a sensor heater output is adjusted to lower the sensor operating temperature. However, due to the higher ambient temperature, and based on the difference between Vp1 and Vp2, the sensor operating temperature can only be reduced from T1 to T3, and cannot be reduced to T2. As a result of the reduction, the margin to the over-potential region is increased, but the increase is not as large as was possible when the temperature was reduced to T2 (at t3–t4). Thus, when Vp2 is applied to the pump cell, a risk of transitioning into the over-potential region is reduced, but not as much as desired. To compensate for the larger margin, at t7, the Nernst cell and pump cell are transitioned to the higher voltage (Vp2 and Vn2) at a slower ramp rate to avoid entry into the over-potential region.

Between t7 and t8, the second voltage Vn2 is applied to the Nernst cell which results in a corresponding change in the voltage of the pump cell to the first voltage Vp2. Between t7 and t8, a change in the current output by the pump cell following application of Vp2 is learned (as delta Ip4). Based on the difference between delta Ip3 and delta Ip4, an oxygen content of exhaust gas is learned and used for air-fuel correction. For example, if the learned oxygen content indicates that the exhaust is richer than stoichiometry, fueling may be reduced to return the air-fuel ratio to stoichiometry. As another example, if the learned oxygen content indicates that the exhaust is leaner than stoichiometry, fueling may be increased to return the air-fuel ratio to stoichiometry.

It will be appreciated that in another example, if the ambient temperature was the same and a larger change in voltage was desired during the variable voltage operation (such as to Vp2' where Vp2'–Vp1 was larger than Vp2–Vp1), then all else being the same, a larger drop in sensor operating temperature would have been required to provide the same margin to the over-potential region. In addition, due to the larger difference in voltages, the voltage may have been transitioned from the lower to the upper voltage at a higher ramp rate.

In this way, responsive to a request for variable voltage operation of an oxygen sensor received while the sensor is at a first temperature and at a first voltage, a controller may adjust an output of an oxygen sensor element to lower the oxygen sensor to a second temperature; and after the lowering, ramp the oxygen sensor from the first voltage to a second voltage, higher than the first voltage, at a ramp rate that is adjusted as a function of the second temperature. Additionally or optionally, the second temperature may be adjusted to limit the second voltage lower than a threshold voltage in an over-potential region of the oxygen sensor. Further, the ramp rate may be decreased as the second temperature approaches the first temperature. The request for variable voltage operation of the oxygen sensor may be responsive to a request for one or more of estimation of an alcohol content of fuel combusted in the engine, estimation of ambient humidity of an intake air charge, and estimation of an oxygen content of the intake air charge or an exhaust gas. The oxygen sensor may be one of an intake oxygen sensor coupled to an intake passage, downstream of an intake throttle, and an exhaust oxygen sensor coupled to an exhaust passage, upstream of an exhaust catalyst.

In this way, by reducing the temperature of an oxygen during a variable voltage mode of operation, a voltage range for the variable voltage operation can be increased. As such, this enables the sensor to be operated with higher accuracy and reliability. In addition, by extending the range, unintended excursions of a pump cell voltage into an over-potential region are reduced. Also, by extending the range and allowing for the sensor to be operated with a larger difference between the lower voltage and the higher voltage applied during a variable voltage mode, a faster rate of voltage ramping is enabled which allows the sensing to be performed within a shorter time, increasing sensor accuracy. By reducing the likelihood of the oxygen sensor operating in the over-potential region, sensor degradation due to sensor element blackening is reduced. As a result, in addition to increasing sensor performance, sensor life in extended.

One example method for an engine comprises: during variable voltage operation of an oxygen sensor, reducing occurrence of blackening of an oxygen sensor element by decreasing an operating temperature of the oxygen sensor from a first temperature to a second temperature before transitioning from a lower operating voltage to a higher operating voltage. In the preceding example, additionally or optionally, the second temperature is adjusted as a function of each of the first temperature, and a difference between the higher operating voltage and a threshold voltage. In any or all of the preceding examples, additionally or optionally, the second temperature is decreased as the difference between the higher operating temperature and the threshold voltage increases, and increased as the first temperature increases. In any or all of the preceding examples, additionally or optionally, the second temperature is further adjusted based on ambient temperature, the second temperature raised towards the first temperature as the ambient temperature increases. In any or all of the preceding examples, additionally or optionally, the method further comprises, as the second temperature is raised, decreasing a rate of ramping from the lower operating voltage to the higher operating voltage. In any or all of the preceding examples, additionally or optionally, the threshold voltage is a voltage where a rate of rise in pump cell voltage for a given change in pump cell current is higher than a threshold. In any or all of the preceding examples, additionally or optionally, decreasing the operating temperature includes decreasing the operating temperature of each of a pump cell and a Nernst cell of the oxygen sensor. In any or all of the preceding examples, additionally or optionally, decreasing the operating temperature includes adjusting an output of a heater element of the oxygen sensor to limit generated during sensor operation, the output including one of a heater current and a heater voltage. In any or all of the preceding examples, additionally or optionally, the method further comprises, after decreasing the operating temperature of the oxygen sensor from the first to the second temperature, transitioning the sensor from the lower voltage to the higher voltage at a rate of ramping, the rate of ramping determined as a function of the second temperature relative to the first temperature. In any or all of the preceding examples, additionally or optionally, the rate of ramping is reduced as a difference between the first temperature and the second temperature decreases. In any or all of the preceding examples, additionally or optionally, the variable voltage operation of the oxygen sensor is responsive to a request for exhaust gas oxygen concentration estimation. In any or all of the preceding examples, additionally or optionally, the method further comprises, generating an indication of fuel alcohol content based on a change in pumping current of the oxygen sensor during the variable voltage operation; and adjusting an engine operating parameter including cylinder fueling based on the indication.

Another example method for an engine comprises: responsive to a request for variable voltage operation of an oxygen sensor received while the sensor is at a first temperature and at a first voltage, adjusting an output of an oxygen sensor element to lower the oxygen sensor to a second temperature; and after the lowering, ramping the oxygen sensor from the first voltage to a second voltage, higher than the first voltage, at a ramp rate that is adjusted as a function of the second temperature. In the preceding example, additionally or optionally, the second temperature is adjusted to limit the second voltage lower than a threshold voltage in an over-potential region of the oxygen sensor. In any or all of the preceding examples, additionally or optionally, the ramp rate is decreased as the second temperature approaches the first temperature. In any or all of the preceding examples, additionally or optionally, the request for variable voltage operation of the oxygen sensor is responsive to a request for one or more of estimation of an alcohol content of fuel combusted in the engine, estimation of ambient humidity of an intake air charge, and estimation of an oxygen content of the intake air charge or an exhaust gas. In any or all of the preceding examples, additionally or optionally, the oxygen sensor is one of an intake oxygen sensor coupled to an intake passage, downstream of an intake throttle, and an exhaust oxygen sensor coupled to an exhaust passage, upstream of an exhaust catalyst.

Another example engine system comprises: an engine including an exhaust; a fuel injector for delivering fuel to an engine cylinder; an oxygen sensor coupled to the exhaust, the oxygen sensor including a heater, a pump cell, and a Nernst cell; and a controller with computer readable instructions stored on non-transitory memory for: applying a first lower voltage across the pump cell; after the applying, adjusting a temperature setting of the heater to lower a temperature of each of the pump cell and the Nernst cell; after the adjusting, increasing a pump cell voltage from the first voltage to a second voltage; based on a change in current of the pump cell at the second voltage relative to the first voltage, estimating an oxygen content of exhaust gas; and adjusting engine fueling responsive to the estimated oxygen content. In the preceding example, additionally or optionally, the system further comprises a temperature sensor for estimating an ambient temperature, wherein the controller includes further instructions for: lowering the temperature of each of the pump cell and the Nernst cell based on the ambient temperature, the temperature setting of the heater adjusted to a higher temperature of each of the pump cell and the Nernst cell as the ambient temperature increases. In any or all of the preceding examples, additionally or optionally, the controller includes further instructions for: increasing the pump cell voltage from the first voltage to the second voltage at a higher ramp rate when the second voltage is higher, and at a lower ramp rate when the second voltage is lower.

In a further representation, during a first condition where an oxygen sensor is at a first operating temperature, after applying a first, lower voltage to a pump cell of the oxygen sensor, the voltage is increased to a second voltage at a first, lower ramping rate. Further, during a second condition, where the oxygen sensor is at a second operating temperature, lower than the first operating temperature, after applying the first voltage to the pump cell of the oxygen sensor, the voltage is increased to a third voltage at a second, higher ramping rate. Herein, the third voltage is higher than the second voltage. Further, during the first condition, a temperature of the oxygen sensor is reduced to the first temperature via adjustments to a sensor heater and during the second condition, the temperature of the oxygen sensor is reduced to the second temperature via adjustments to the sensor heater. Further, during the first condition, an ambient temperature is higher and during the second condition, the ambient temperature is lower.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during variable voltage operation of an oxygen sensor, reducing occurrence of blackening of an oxygen sensor element by decreasing an operating temperature of the oxygen sensor from a first temperature to a second temperature before transitioning from a lower operating voltage to a higher operating voltage.

2. The method of claim 1, wherein the second temperature is adjusted as a function of each of the first temperature, and a difference between the higher operating voltage and a threshold voltage.

3. The method of claim 2, wherein the second temperature is decreased as the difference between the higher operating temperature and the threshold voltage increases, and increased as the first temperature increases.

4. The method of claim 3, wherein the second temperature is further adjusted based on ambient temperature, the second temperature raised towards the first temperature as the ambient temperature increases.

5. The method of claim 4, further comprising, as the second temperature is raised, decreasing a rate of ramping from the lower operating voltage to the higher operating voltage.

6. The method of claim 1, wherein the threshold voltage is a voltage where a rate of rise in pump cell voltage for a given change in pump cell current is higher than a threshold.

7. The method of claim 1, wherein decreasing the operating temperature includes decreasing the operating temperature of each of a pump cell and a Nernst cell of the oxygen sensor.

8. The method of claim 1, wherein decreasing the operating temperature includes adjusting an output of a heater element of the oxygen sensor to limit generated during sensor operation, the output including one of a heater current and a heater voltage.

9. The method of claim 1, further comprising, after decreasing the operating temperature of the oxygen sensor from the first to the second temperature, transitioning the sensor from the lower voltage to the higher voltage at a rate of ramping, the rate of ramping determined as a function of the second temperature relative to the first temperature.

10. The method of claim 9, wherein the rate of ramping is reduced as a difference between the first temperature and the second temperature decreases.

11. The method of claim 1, wherein the variable voltage operation of the oxygen sensor is responsive to a request for exhaust gas oxygen concentration estimation.

12. The method of claim 1, further comprising, generating an indication of fuel alcohol content based on a change in pumping current of the oxygen sensor during the variable voltage operation; and adjusting an engine operating parameter including cylinder fueling based on the indication.

13. A method for an engine, comprising:

responsive to a request for variable voltage operation of an oxygen sensor received while the sensor is at a first temperature and at a first voltage, adjusting an output of an oxygen sensor element to lower the oxygen sensor to a second temperature; and after the lowering, ramping the oxygen sensor from the first voltage to a second voltage, higher than the first voltage, at a ramp rate that is adjusted as a function of the second temperature.

14. The method of claim 13, wherein the second temperature is adjusted to limit the second voltage lower than a threshold voltage in an over-potential region of the oxygen sensor.

15. The method of claim 13, wherein the ramp rate is decreased as the second temperature approaches the first temperature.

16. The method of claim 13, wherein the request for variable voltage operation of the oxygen sensor is responsive to a request for one or more of estimation of an alcohol content of fuel combusted in the engine, estimation of ambient humidity of an intake air charge, and estimation of an oxygen content of the intake air charge or an exhaust gas.

17. The method of claim 13, wherein the oxygen sensor is one of an intake oxygen sensor coupled to an intake passage, downstream of an intake throttle, and an exhaust oxygen sensor coupled to an exhaust passage, upstream of an exhaust catalyst.

18. An engine system, comprising:

an engine including an exhaust;

a fuel injector for delivering fuel to an engine cylinder;

an oxygen sensor coupled to the exhaust, the oxygen sensor including a heater, a pump cell, and a Nernst cell; and a controller with computer readable instructions stored on non-transitory memory for:

applying a first lower voltage across the pump cell;

after the applying, adjusting a temperature setting of the heater to lower a temperature of each of the pump cell and the Nernst cell;

after the adjusting, increasing a pump cell voltage from the first voltage to a second voltage;

based on a change in current of the pump cell at the second voltage relative to the first voltage, estimating an oxygen content of exhaust gas; and adjusting engine fueling responsive to the estimated oxygen content.

19. The system of claim 18, further comprising a temperature sensor for estimating an ambient temperature, wherein the controller includes further instructions for:

lowering the temperature of each of the pump cell and the Nernst cell based on the ambient temperature, the temperature setting of the heater adjusted to a higher temperature of each of the pump cell and the Nernst cell as the ambient temperature increases.

20. The system of claim 18, wherein the controller includes further instructions for:

increasing the pump cell voltage from the first voltage to the second voltage at a higher ramp rate when the second voltage is higher, and at a lower ramp rate when the second voltage is lower.

* * * * *